US006390793B1

(12) United States Patent
Sweet et al.

(10) Patent No.: US 6,390,793 B1
(45) Date of Patent: May 21, 2002

(54) ROTARY GEAR PUMP WITH FLUID INLET SIZE COMPENSATION

(75) Inventors: Robert S. Sweet; Jimmy B. Hite, both of Rockford, IL (US)

(73) Assignee: Haldex Barnes Corporation, Rockford, IL (US)

( * ) Notice: Subject to any disclaimer, the term of this patent is extended or adjusted under 35 U.S.C. 154(b) by 0 days.

(21) Appl. No.: 09/782,010

(22) Filed: Feb. 13, 2001

(51) Int. Cl.[7] ..... F03C 2/08; F03C 2/18
(52) U.S. Cl. ..... 418/132
(58) Field of Search ..... 418/132

(56) References Cited

U.S. PATENT DOCUMENTS 2,714,856 A * 8/1955 Kane ..... 418/132
2,891,483 A * 6/1959 Murray et al. ..... 418/132
3,137,238 A * 6/1964 Gordon ..... 418/132
3,748,063 A * 7/1973 Putnam ..... 418/132
4,087,216 A * 5/1978 Shumate ..... 418/131
4,090,820 A * 5/1978 Teruyama ..... 418/132
4,292,013 A * 9/1981 Singer et al. ..... 418/132
4,358,260 A * 11/1982 Joyner ..... 418/132

FOREIGN PATENT DOCUMENTS

GB 1442897 * 7/1976
SU 1105689 * 3/1983

* cited by examiner

*Primary Examiner*—John J. Vrablik
(74) *Attorney, Agent, or Firm*—Lathrop & Clark LLP

(57) ABSTRACT

A chamfer is formed in bearing blocks on either side of the hydraulic fluid inlet. The chamfer allows a family of pumps with varying hydraulic inlet sizes to have similar bearing block pressure profiles. The chamfer prevents the build up of hydraulic pressure immediately adjacent to the hydraulic inlet below a given inlet size so that the bearing block pressure profile for a family of pumps with different inlet sizes more nearly matches the pressure profile of the largest opening used in a particular design family. The sealing gasket on the side of the bearing block opposite the gears is designed to accommodate this single pressure profile. The result is an improved bearing life and reduced slippage over an entire family of pumps or motors of similar design.

6 Claims, 3 Drawing Sheets

ROTARY GEAR PUMP WITH FLUID INLET SIZE COMPENSATION

CROSS REFERENCES TO RELATED APPLICATIONS

Not applicable

STATEMENT AS TO RIGHTS TO INVENTIONS MADE UNDER FEDERALLY SPONSORED RESEARCH AND DEVELOPMENT

No applicable

BACKGROUND OF THE INVENTION

The present invention relates to rotary gear pumps and motors in general, and to the type having pressure balanced bearing block seals in particular.

So-called external gear pumps are used in hydraulic power applications, as both motors and pumps. Reasonable efficiency, long life, and low-cost are normally the design criteria for these widely used pumps and motors. An external gear pump has a pair of intermeshing gears. The gears incorporate shafts which are parallel and which are mounted in bearing blocks which seal the ends of the gears. The gears are contained within a housing and hydraulic oil is supplied at an inlet and is pumped to an outlet on the other side of the meshing gears.

External gear pumps or motors, when used in hydraulic power applications, operate with pressures of up to several thousand pounds per square inch (psi). The high differential pressure and the importance of efficiency makes pump slip a concern. Slip is the fluid flow which leaks from the high-pressure side of the pump or motor to the low-pressure side. The design of external gear pumps minimizes pump slip by careful attention to pump design details. One major source of pump slip is the seal between the end faces of the rotors/gears and opposed bearing blocks. The opposed bearing blocks contain the bearings into which the shafts on which the gears are mounted turn.

The bearing blocks are positioned above and below the rotors in a twin lobe passageway formed in the motor housing. Oil pressure is allowed to reach the distal sides of the bearing blocks, forcing them toward the end faces of the rotors. However, the bearing blocks necessarily must be supported with uneven pressure so as to match the pressure developed within the pump as the rotors turn to carrying fluid from the low-pressure side of the pump to the high-pressure side. If the pressure on the sides of the bearing blocks opposed to the end faces of the rotor are not adequately matched to the pressures developed between the gear teeth of the pump, excessive slippage or bearing block face wear will result. Proper balancing of pressure on the side of the bearing blocks opposite to the end faces of the rotor is typically accomplished by a sealing gasket which supplies different pressures to different portions of the bearing blocks.

The tooling costs for the fabrication of bearing blocks is high, as the finish and dimensions of the block require tight tolerances. Thus, a single block design is often used in several different pump designs. Typically a family of hydraulic pumps will be designed to accommodate a range of hydraulic fluid inlet sizes. The inlet size of the hydraulic pump causes a variation in the hydraulic loading on the bearing blocks. Therefore, the design of the sealing gasket has to the present time been a compromise.

What is needed is a family of external hydraulic gear pumps which can accommodate a variety of hydraulic fluid inlets with a single bearing block design which has better bearing block sealing and reduced bearing block face wear.

SUMMARY OF THE INVENTION

The external hydraulic gear pump of this invention incorporates a chamfer in the bearing blocks on either side of the hydraulic fluid inlet. The chamfer functions to cause a family of pump designs with varying hydraulic inlet sizes, to have similar bearing block pressure profiles. The chamfer prevents the buildup of hydraulic pressure immediately adjacent to the hydraulic inlet below a given inlet size so that the bearing block pressure profile for a family of pumps with different inlet sizes more nearly matches the pressure profile of the largest opening used in a particular design family. The sealing gasket on the side of the bearing block opposite the gears is designed to accommodate this single pressure profile. The result is an improved bearing life and reduced slippage, over an entire family of pumps and motors of similar design.

It is an object of the present invention to reduce the cost of producing a family of hydraulic pumps or motors.

It is another object of the present invention to provide a family of hydraulic pumps or motors wherein the needed hydraulic sealing pressure remains substantially constant over a range of hydraulic fluid inlet sizes.

It is a further object of the present invention to provide a family of hydraulic pumps or motors with reduced wear.

Further objects, features and advantages of the invention will be apparent from the following detailed description when taken in conjunction with the accompanying drawings.

DESCRIPTION OF THE PREFERRED EMBODIMENTS

Figure 1:
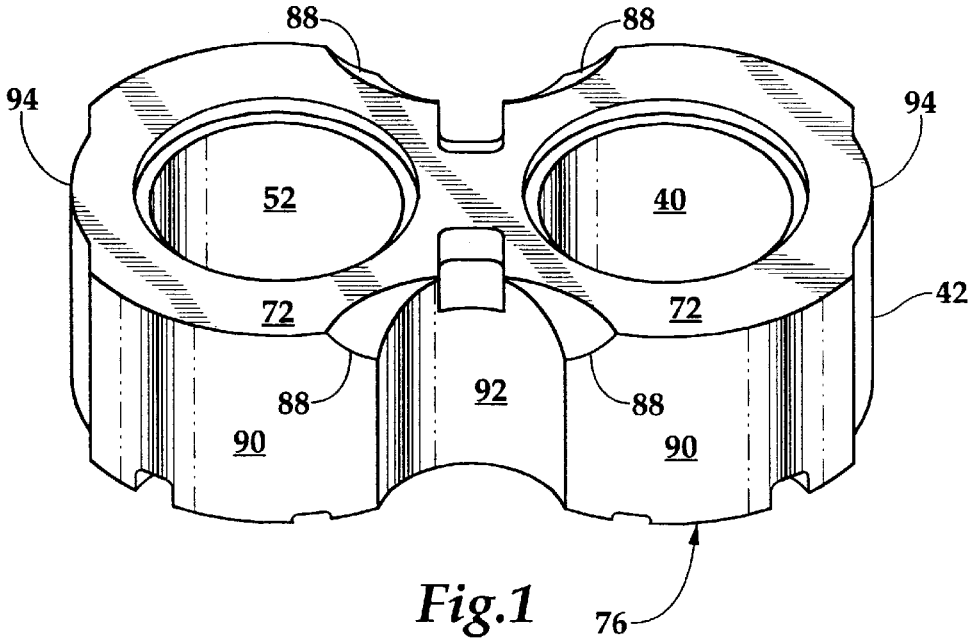
FIG. 1 is an enlarged isometric view of a bearing block incorporating the chamfer of this invention which allows more uniform pressure compensation for motors with varying inlet sizes.
Figure 2:
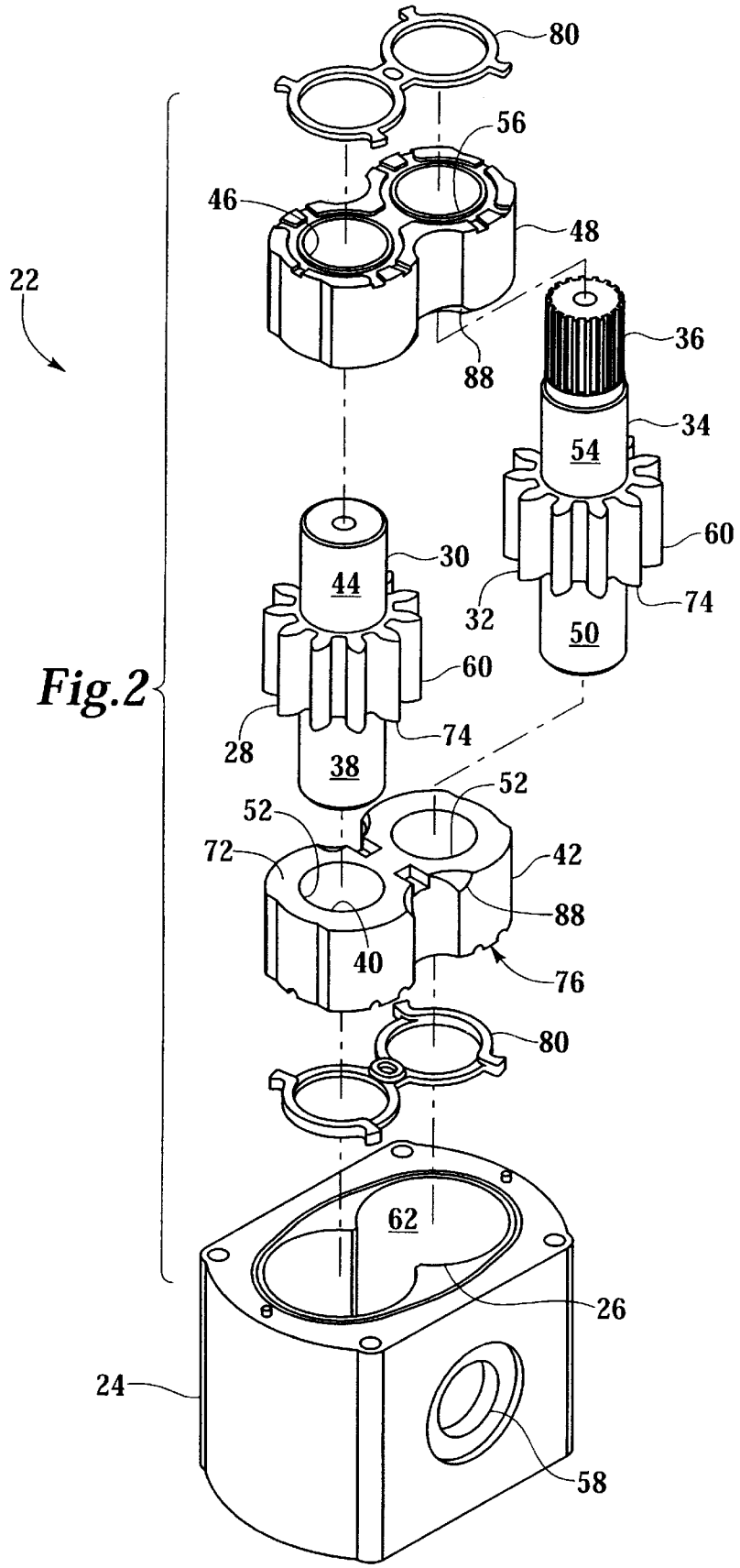
FIG. 2 is an exploded isometric view of the pump with this invention showing the location and arrangement of the bearing blocks and bearing block hydraulic balancing seals.

Referring more particularly to FIGS. 1–4 wherein like numbers refer to similar parts, a pump 22, is shown in FIG. 2. The pump 22 has a housing 24 which has a central bore 26 in which are mounted a first gear 28 mounted to a first shaft 30, and a second gear 32 mounted to a drive shaft 34. The drive shaft 34 has a spline 36 to allow the shaft to be connected to a mechanism to be driven, in the case of a motor, or to a drive source such as an electric motor in the case of the pump. The first shaft 30, has a first bearing surface 38 which rides on a first bearing 40 in a first bearing block 42. The first shaft 30 has a second bearing surface 44 which rides in a second bearing 46 in a second bearing block 48. In a similar way the drive shaft 34 has a first bearing surface 50 which rides in a bearing 52 in the first bearing block 42 and a second bearing surface 54 which ride in a bearing 56 in the second bearing block 48.

Figure 3:
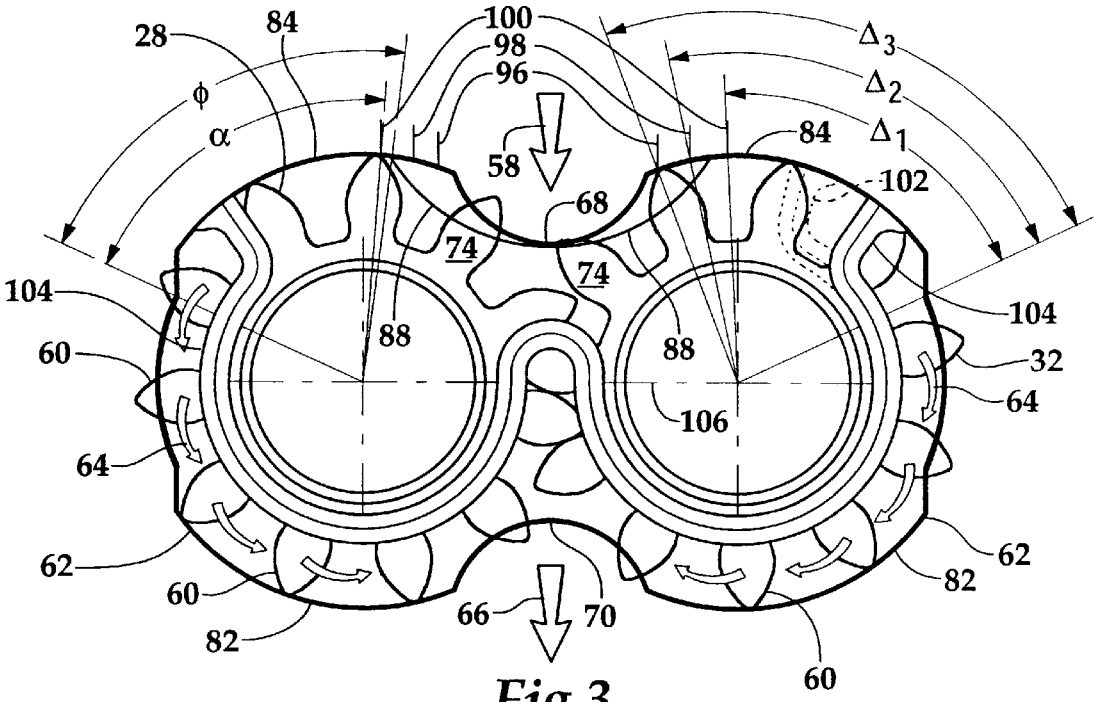
FIG. 3 is a schematic illustrative view shown superimposed on a top view of the bearing block, the gear teeth, the block chamfer, three inlet ports of varying size, and the prior art balancing seal, and the improved balancing seal, which are positioned on the bottom of the bearing block, but shown superimposed on the top of a bearing block.

The pump housing 24 has an inlet 58 through which hydraulic fluid is supplied. As shown in FIG. 3, the first gear 28 and the second gear 32 intermesh so that only a small volume of hydraulic fluid moves toward the inlet 58 indicated by an arrow. The individual teeth 60 of the gears 28 and 32 rotate along the walls 62 of the central bore 26 of the housing 24 as indicated by arrows 64. As the gear teeth 60 rotate they sweep along a substantial volume of hydraulic fluid which flows to the outlet 66 of the pump 22.

As the gear teeth 60 rotate they move hydraulic fluid from the low-pressure side 68 to the high-pressure side 70 of the pump 22. Pressure begins to build up in the hydraulic fluid when it becomes trapped between adjacent gear teeth 60 and the housing 24. Thus, the beginning of pressure buildup starts when a volume of fluid is no longer in communication with low-pressure side 68 of the pump 22. Pressure is built up along an arc such as that labeled $\alpha$ in FIG. 3. The sealing surface 72 of the bearing block 42 as shown in FIG. 1 and as represented in FIG. 3 is sealed against the open sides 74 of the gears 28, 32. In order to form a good seal, the bearing blocks 42, 48 are forced against the gear open sides 74 by hydraulic pressure which has access to the distal sides 76 of the bearing block 42.

A sealing gasket 80, as shown in FIG. 2, engages the distal sides 76 of the bearing blocks 42, 48. The seal formed by the gasket 80 divides the bottom surface into a portion 82 which communicates with the high-pressure side of the pump, and a portion 84 which is in communication with the low-pressure side of the pump. The seal 80 is designed so that the high-pressure and low-pressure portions 82, 84 balance the pressure profile on the sealing surfaces 72 of the bearing blocks 42, 48. The design of the seals 80 is complicated by the desirability of manufacturing a family of pumps with identical mechanical components differing only in the size of the hydraulic inlet 58.

FIG. 1 shows a chamfer 88 which relieves a portion of the sealing surface 72 of the bearing block 42. The effect of the chamfer 88 is to control the position where pressure begins to build up as the gear teeth 60 rotate as shown by arrow 64 toward the high-pressure side of the pump 22. The bearing block 42 has a vertical surface 90 which engages the central bore 26 of the housing 24. The bearing block has cylindrical surfaces 92 which form the waist of the figure eight of the bearing block 42. The top and bottom of the figure eight have portions 94 which are relieved. The relieved portions 94 communicate with the high-pressure side 70 of the pump 22 as shown in FIG. 3. The relieved portions 94 are in communication with a high-pressure side 70 of the pump 22 because the high-pressure fluid forces the bearing block 42 toward the low-pressure side of the pump housing 24, opening up a small gap between the bearing block 42 and the wall 62 of the housing 24.

FIG. 3 shows the size and positioning of three possible inlet openings 58. For purposes of explanation a pair of lines 96 define an inlet of ⅞ inch diameter, a second pair of lines 98 define an inlet of 1 1/16 inch diameter, and the third pair of lines 100 define an inlet of 1 5/16 inch diameter. The right side of FIG. 3 shows three regions of pressure buildup corresponding to each of the three different diameters. $\Delta_1$ is the region of pressure buildup which corresponds with an inlet diameter of 1 5/16 inches; $\Delta_2$ is the region of pressure buildup which corresponds with an inlet diameter of 1 1/16 inches; and $\Delta_3$ is the region of pressure buildup which corresponds with an inlet diameter of ⅞ inches. These pressure buildup regions correspond to the prior art. With prior art designs a sealing gasket 102 was selected based on $\Delta_3$ which corresponded to the smallest inlet diameter 96. This results in the prior art design having substantially sub-optimal bearing support for the larger inlets 98, 100. In other words the oil pressure profile on the distal sides 76 in the prior art approach does not match the oil pressure on the sealing sides 72, for the larger in the openings.

As can be seen from FIG. 3 the buildup of pressure within the space between gear teeth 60, begins when a space is isolated from the inlet 58, and is complete when the space between gear teeth 60 communicates with, the high-pressure side which occurs when the space between gear teeth 60, overlies the relieved portion 94 of the bearing blocks 42, 48. Isolation from the inlet 58 is controlled by either the inlet or the chamfer 88. The effect of the chamfer 88 is to substantially eliminate the effect the inlet diameter has on the beginning of pressure buildup.

The effect of the chamfer 88 is shown on the left-hand side of FIG. 3 where pressure buildup regions $\alpha$ and $\phi$ are very nearly the same. The pressure buildup region $\phi$ is controlled by the size of the chamfer, and is the same for the ⅞ inch inlet 96 and the 1 1/16 inch inlet 98. The largest inlet 100 at 1 5/16 is slightly larger than the chamfer 88 and results in the pressure buildup region $\alpha$. Because the pressure buildup regions $\alpha$ and $\phi$ are very nearly the same, a sealing gasket 104 can be designed which is more optimal for hydraulic pumps with a range of inlet sizes. In the example shown in FIG. 3, the prior art gasket 102 optimized for the ⅞ inch inlet 96, extends about 71 degrees from the symmetry 106, while the improved sealing gasket 104 extends only about 54.6 degrees from the symmetry axis 106.

So that the same bearing block 42 may be used in pumps and motors, and two identical bearing block 42 may be used in a single pump or motor, the bearing blocks 42, 48 are identical and symmetric such that a chamfer 88 is positioned next to both the inlet 58 and the outlet 66, however when positioned near the outlet the chamfer has little or no effect.

In the same way, the sealing gasket 104 is made to function symmetrically by duplicating it about the symmetry axis 106, shown in FIG. 3 and thus in actually use has the shape shown in FIG. 2 for the sealing gasket 80.

It should be understood that the chamfer 88 differs substantially from features used in prior art motor designs which prevented the over-rapid buildup of pressure as the teeth 60 move into the region of pressure buildup. Such prior art features include a very shallow groove in the sealing surface 72, designed to prevent a pressure spike due to the incompressibility of the hydraulic fluid. The chamfer 88 differs from such a feature designed to prevent chatter due to the incompressibility of the working fluid, because it substantially changes the pressure buildup profile, while the anti-chatter features only prevent a pressure spike, but do not allow free flow of fluid into the gap between gear teeth. The chamfer 88 as, is shown in FIG. 1 as a simple relieving of the surface 72 which allows free flow of hydraulic the chamfer 88 does not result in the removal of so much material that the vertical surfaces 90 which engages the bearing blocks 42, 48 with the walls 62 of the housing 24 are significantly reduced in bearing area.

Figure 4:
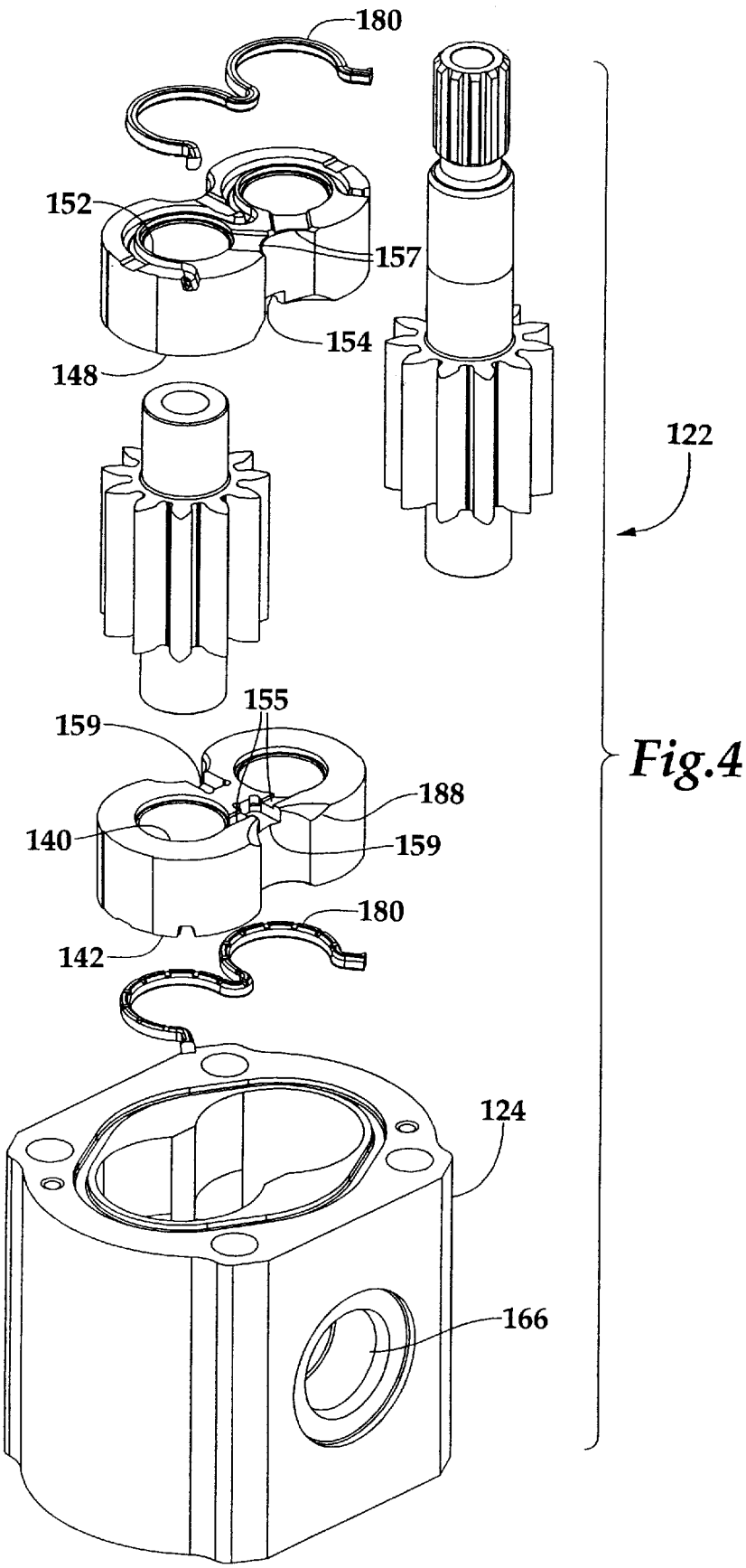
FIG. 4 is an exploded isometric view of an alternative embodiment pump with this invention showing the location and arrangement of the bearing blocks and bearing block hydraulic balancing seals.

FIG. 4 shows an alternative embodiment hydraulic pump 122, where the arrangement of the bearing blocks 142, 148 and the seals 180 are optimized for a pump in which the gears 128, 132 rotate in a single direction. Because the pump gears rotate only in a single direction a "3" shaped seal 180 is all that is necessary. Because the pump 122 rotates in only a single direction chamfers 188 are only required on the low-pressure side of the pump 122.

The low-pressure side of the pump 122 is considerably lower pressure generally than the low-pressure side of a similar hydraulic motor. The hydraulic pump 122 of FIG. 4 utilizes this fact to facilitate lubrication of the shaft bearings 140, 156. Provision is made on the bearing surfaces 172 of the bearing blocks 142, 148 to drain oil to the low-pressure side from the shaft bearings 140, 156, by connecting the shaft bearings with the low-pressure side of the pump to facilitate bearing lubrication. This is accomplished by passageways 155 in the bearing surfaces 172 of the bearing blocks 142, 148 and on the underside of the blocks by similar passages 157.

The high-pressure openings formed by the end portions 94 of the bearing blocks in FIG. 1 are designed to allow rapid filling of the gear teeth with hydraulic fluid. Openings at the end of the bearing blocks are larger in a motor where it is desirable to fill the gears rapidly with fluid, than in a pump 122 where filling is more readily affected.

The precise shape of the U-shaped indentations 159 at the neck of the figure eight shaped bearing blocks as shown in FIG. 4 are designed for tool path economy and positioning exactly where the spaces between the gear teeth 160 are connected with the high- and low-pressure sides of the pump 122.

The pump housing 124 in FIG. 4 has a high-pressure outlet (not shown) to which hydraulic fluid is pumped. The chamfer 188, which controls the pressure profile on the bearing blocks, faces the low-pressure inlet 166.

It should be understood that although a hydraulic pump is described in the claims, the term hydraulic pump should be understood to include a hydraulic motor, because the hydraulic pump and motor can be identical in structure, much as an electric motor can operate as a generator.

It should also be understood that the term fluid inlet refers to the low-pressure side of the pump, and should also be understood as referring to the low-pressure (fluid outlet) side of a hydraulic motor, so that the invention when claimed as a motor reads on a hydraulic pump. Similarly the term fluid outlet refers to the high-pressure side of the hydraulic pump and should also be understood as referring to the high-pressure (fluid inlet) side of a hydraulic motor, so that the invention when claimed as a pump reads on a hydraulic motor. Moreover, fluid described as flowing from the low-pressure side to the high-pressure side in a pump, should be understood to include fluid flowing from the high-pressure side to the low-pressure side in a motor.

It should be understood that the hydraulic motor or pump can be used in a wide variety of applications. See, for example, U.S. Pat. No. 6,010,321 to Forsythe et al. which is incorporated herein by reference.

It is understood that the invention is not limited to the particular construction and arrangement of parts herein illustrated and described, but embraces such modified forms thereof as come within the scope of the following claims.

We claim:

1. A hydraulic machine of an external gear type comprising:

a machine having a housing, the housing having a low-pressure fluid connection of a selected diameter, and a high-pressure fluid connection, and positioned within the housing, a first gear, the first gear mounted to a first shaft extending above and below the first gear; a second gear, the second gear mounted to a second shaft extending above and below the second gear in spaced parallel relation to the first shaft, the first and second gears being in a fluid communicating relation with the housing low-pressure fluid connection, to transport fluid between the low-pressure fluid connection and the high-pressure fluid connection by engaging the fluid between said first gear and the housing and between said second gear and the housing; an upper bearing block and a lower bearing block, the upper bearing block receiving the portion of the first shaft and the second shaft extending above the first and second gears, the lower bearing block receiving the portion of the first shaft and the second shaft extending below the first and second gears, the upper bearing block having a first side in sealing engagement with the first and second gears, and a second side opposite the first side, the second side having a seal which divides the second side into a portion in communication with the low-pressure fluid connection, and a portion in communication with the high-pressure fluid connection, so as to balance hydraulic pressure on the first and second sides of the upper bearing block; the lower bearing block having a first side in sealing engagement with the first and second gears, and a second side opposite the first side, the second side having a seal which divides the second side into a portion in communication with the low-pressure connection, and a portion in communication with the high-pressure connection, so as to balance hydraulic pressure on the first and second sides of the lower bearing block; and wherein the improvement comprises, at least the upper bearing block of the machine having portions defining a chamfer on the first side, adjacent to the low-pressure connection, so that the low-pressure connection creates substantially the same pressure profile on said first side over a range of selected low-pressure connection diameters.

2. The hydraulic machine of claim 1 wherein the the upper bearing block and the lower bearing block are substantially identical.

3. A hydraulic pump of an external gear type comprising:

a pump having a housing, the housing having a fluid inlet of a selected diameter, and a fluid outlet, and positioned within the housing, a first gear, the first gear mounted to a first shaft extending above and below the first gear; a second gear, the second gear mounted to a second shaft extending above and below the second gear in spaced parallel relation to the first shaft, the first and second gears being in a fluid receiving relation with the housing inlet, to transport fluid between said first gear and the housing and said second gear and the housing to the pump outlet; an upper bearing block and a lower bearing block, the upper bearing block receiving the portion of the first shaft and the second shaft extending above the first and second gear, the lower bearing block receiving the portion of the first shaft in the second shaft extending below the first and second gear, the upper bearing block having a first side in sealing engagement with the first and second gears, and a second side opposite the first side, the second side having a seal which divides the second side into a portion in communication with the inlet, and a portion in communication with the outlet, so as to balance hydraulic pressure on the first and second sides of the upper bearing block; the lower bearing block having a first side in sealing engagement with the first and second gears, and a second side opposite the first side, the second side having a seal which divides the second side into a portion in communication with the inlet, and a portion in communication with the outlet, so as to balance hydraulic pressure on the first and second sides of the lower bearing block; and wherein the improvement comprises, at least the upper bearing block of the pump having portions defining a chamfer on the first side, adjacent to the pump inlet, so that the pump inlet creates substantially the same pressure profile on said first side over a range of selected inlet diameters.

4. The hydraulic pump of claim 3 wherein the the upper bearing block and the lower bearing block are substantially identical.

5. A family of hydraulic pumps of an external gear type, comprising:

a first pump having a first housing, the housing having a fluid inlet of a first diameter, and a fluid outlet, and positioned within the housing, a first gear, the first gear mounted to a first shaft extending above and below the first gear, a second gear, the second gear mounted to a second shaft extending above and below the second gear in spaced parallel relation to the first shaft, the first and second gears being in a fluid receiving relation with the housing inlet, to transport fluid between the first gear and the housing and the second gear and the housing to the pump outlet; an upper bearing block and a lower bearing block, the upper bearing block receiving the portion of the first shaft and the second shaft extending above the first and second gear, the lower bearing block receiving the portion of the first shaft and the second shaft extending below the first and second gear, the upper bearing block having a first side in sealing engagement with the first and second gears, and a second side opposite the first side, the second side having a seal which divides the second side into a portion in communication with the inlet, and a portion in communication with the outlet, so as to balance hydraulic pressure on the first and second sides of the upper bearing block; the lower bearing block having a first side in sealing engagement with the first and second gears, and a second side opposite the first side, the second side having a seal which divides the second side into a portion in communication with the inlet, and a portion in communication with the outlet, so as to balance hydraulic pressure on the first and second sides of the lower bearing block;

a second pump having a second housing, the second housing having a fluid inlet of a second diameter larger than the first diameter, and a fluid outlet, and positioned within the second housing, a first gear, the first gear mounted to a first shaft extending above and below the first gear, a second gear, the second gear amounted to a second shaft extending above and below the second gear in spaced parallel relation to the first shaft, the first and second gears being in a fluid receiving relation with the housing inlet, to transport fluid between said first gear and the housing and said second gear and the housing to the pump outlet; an upper bearing block and a lower bearing block, the upper bearing block receiving the portion of the first shaft and the second shaft extending above the first and second gear, the lower bearing block receiving the portion of the first shaft in the second shaft extending below the first and second gear, the upper bearing block having a first side in sealing engagement with the first and second gears, and a second side opposite the first side, the second side having a seal which divides the second side into a portion in communication with the inlet, and a portion in communication with the outlet, so as to balance hydraulic pressure on the first and second sides of the upper bearing block; the lower bearing block having a first side in sealing engagement with the first and second gears, and a second side opposite the first side, the second side having a seal which divides the second side into a portion in communication with the inlet, and a portion in communication with the outlet, so as to balance hydraulic pressure on the first and second sides of the lower bearing block; and wherein the upper bearing block of the first pump, and the upper bearing block of the second pump are substantially identical, and wherein a portion of said upper bearing blocks of the first pump and of the second pump define a chamfer extending from the first sides of said upper bearing blocks, adjacent to the pump inlet, so that the first pump inlet creates substantially the same pressure profile on the first side of the upper bearing block of the first pump, as the second pump inlet creates on the first side of the upper bearing block of the second pump when said first and second pumps are operated at substantially identical pressures.

6. The family of hydraulic pumps of claim 5 wherein the upper and lower bearing blocks of the first and second pumps are all substantially identical.

* * * * *